US005212465A

United States Patent [19]

Mizutani et al.

[11] Patent Number: 5,212,465

[45] Date of Patent: May 18, 1993

[54] THREE-PHASE THERMAL PROTECTOR

[75] Inventors: Yasukazu Mizutani, Nagoya; Isao Higashikata, Owariasahi; Hideki Koseki, Aichi, all of Japan

[73] Assignee: Ubukata Industries Co., Ltd., Nagoya, Japan

[21] Appl. No.: 928,284

[22] Filed: Aug. 12, 1992

[51] Int. Cl.[5] ..... H01H 37/12; H01H 37/54; H01H 61/08

[52] U.S. Cl. ..... 337/368; 337/94; 337/347; 337/377

[58] Field of Search ..... 337/368, 57, 94, 347, 337/349, 360, 377, 82, 365, 89

[56] References Cited

U.S. PATENT DOCUMENTS

| | | | |
|---|---|---|---|
| 4,843,363 | 6/1989 | Ubukata et al. | 337/368 |
| 4,914,414 | 4/1990 | Ubukata et al. | 337/89 |
| 5,107,241 | 4/1992 | Ubukata et al. | 337/368 |

FOREIGN PATENT DOCUMENTS

| | | |
|---|---|---|
| 31-5747 | 4/1956 | Japan . |
| 46-34532 | 10/1971 | Japan . |
| 1-105435 | 4/1989 | Japan . |

*Primary Examiner*—Harold Broome

*Attorney, Agent, or Firm*—Foley & Lardner

[57] ABSTRACT

A three-phase thermal protector includes a hermetic receptacle composed of an elliptic dome-shaped cover having an opening at one end and a header plate having two terminal pins extending through respective apertures formed in it, and a switch assembly mounted in the receptacle. Two fixed contacts are secured to the respective terminal pins. The switch assembly includes a metal operating temperature calibrating plate with one end welded to the cover, a bimetallic thermally responsive element having one end secured to the calibrating plate and the other end having a central dish-shaped portion, and a thermally-responsive-element support to which the supported end of the thermally responsive element is welded. The thermally responsive element carries two movable contacts symmetrical about the center line. The calibrating plate has a push projection pushing the thermally responsive element so that the contact pressure is increased when the calibrating plate is deformed with deformation of the cover for the calibration of the operating temperature. The header plate has a protrusion receiving the thermally responsive element at a position away from its supported end toward the center.

10 Claims, 6 Drawing Sheets

THREE-PHASE THERMAL PROTECTOR

BACKGROUND OF THE INVENTION

1. Field of the invention

This invention relates to a three-phase thermal protector suitable for opening and closing a neutral of wye-connected phase windings of three-phase induction motors for protecting the motors against overcurrent and overload conditions or suitable for protecting like electric machines.

2. Description of the prior art

Conventional three-phase thermal protectors of the above-described type are disclosed by Japanese Published Utility Model Registration Application No. 31-5747 entitled "DISH-SHAPED BIMETAL RELAY WITH THREE PAIRS OF CONTACTS" or by Japanese Published Patent Application No. 46-34532 entitled "THERMOSTAT SWITCH." Six contacts, that is, three pairs of movable and fixed contacts are employed in each of the above mentioned protectors. Such a number of contacts entails an economic problem that the manufacturing cost of the protector is increased.

The applicants of the present application have disclosed, in Japanese Laid-open Patent Application No. 1-105435, a three-phase thermal protector in which the number of the contacts is reduced to four, that is, two pairs of movable and fixed contacts. However, a screw is employed in an operating temperature calibrating mechanism in this three-phase thermal protector. Provision of the screw requires a high level of accuracy in manufacture of the protectors and increases the number of parts. Furthermore, it is disadvantageous that the deviation in the calibrated operating temperature cannot be corrected after a header plate has been welded to a housing for its hermetic sealing after completion of the calibration of the operating temperature.

SUMMARY OF THE INVENTION

Therefore, an object of the present invention is to provide a three-phase thermal protector which can overcome the above-described disadvantages encountered in the conventional protectors and can provide a long service life and a stable product quality.

In one aspect of the present invention, a three-phase thermal protector comprises a hermetic receptacle comprising a cover formed of a metallic material and having an opening the width of which is larger than the depth of the cover, and a header plate hermetically secured to an opening edge of the cover and having two through-apertures. Two electrically conductive terminal pins are inserted through the respective through-apertures of the header plate. Each terminal pin is hermetically secured in each through-aperture by an electrically insulating material filling a space between the peripheral wall surface of each aperture and the outer periphery of each terminal pin. Each terminal pin has an end placed in the interior of the hermetic receptacle and a fixed contact electrically conductively connected to the end. An operating temperature calibrating plate formed of a metallic material is disposed in the receptacle. The operating temperature calibrating plate has an end side secured to the cover of the receptacle by way of welding and a suitable portion more bendable than the other portion thereof. A thermally-responsive-element support has one of two ends secured to the operating temperature calibrating plate and a cutout portion at a suitable portion thereof. The thermally-responsive-element support is elastically deformable easily in a direction intersecting perpendicularly to a plane thereof. A thermally responsive element has a supported end secured to the other end of the thermally-responsive-element support and a generally central shallow dish-shaped portion reversing its curvature with a snap action at predetermined temperatures, the thermally responsive element carries two movable contacts on respective portions thereof substantially symmetrical about a central line passing through the supported end so that the movable contacts are operatively associated with the respective fixed contacts. A protrusion is fixedly disposed on the header plate so as to be positioned between the thermally responsive element and the header plate. The protrusion has a distal end in contact with a portion of an underside of the thermally responsive element away from the central portion thereof toward the supported end. The portion of the thermally responsive element in contact with the distal end of the protrusion acts as a fulcrum. A push projection is provided on the operating temperature calibrating plate so that its distal end extends through the cutout portion of the thermally-responsive-element support. The distal end pushing a convex side of the thermally responsive element at a room temperature, in the vicinity of a portion thereof on which the center line passes through the supported end such that a pushing force of the push projection is dispersed equally to the distal end of the protrusion and the fixed contacts. The push projection is moved with movement of a free end of the operating temperature calibrating plate upon displacement applied to the cover of the receptacle for calibration of an operating temperature.

In accordance with the present invention, the thermally responsive element is usually biased by the thermally-responsive-element support so as to be inclinably moved slightly about the protrusion in the direction in which the contact pairs are opened. Consequently, failures due to the welding between the contacts can be prevented.

An accurate calibration of the operating temperature of the thermally responsive element can be achieved in the present invention since the operating temperature calibrating plate acts as a lever in the state that it is deformed for the calibration of the operating temperature.

The thermally responsive element is pushed by the push protrusion on the portion between the two movable contacts and in the vicinity of its portion on which the center line passes through the supported end. Consequently, the thermally responsive element is self-aligned such that an equal contact pressure is applied to the pairs of contacts. The simultaneous opening operation of the contact pairs can be stabilized.

In another aspect of the invention, the fixed contacts are disposed on one ends of the two fixed-contact supports disposed in the receptacle to be substantially parallel to the header plate, respectively. A return period of the contact pairs from the off-state to the on-state can be relatively prolonged by the heating of the fixed-contact support due to a current flowing through it. Consequently, a long life of the contacts can be expected.

Additionally, the present invention can provide a three-phase thermal protector which is small in size and easy in assembly and has a sufficient pressure tightness.

Other objects of the present invention will become obvious upon understanding of the illustrative embodiments about to be described. Various advantages not referred to herein will occur to one skilled in the art upon employment of the invention in practice.

BRIEF DESCRIPTION OF THE DRAWINGS

Embodiments of the present invention will be described with reference to the accompanying drawings in which.

DESCRIPTION OF THE PREFERRED EMBODIMENTS

Figure 1:
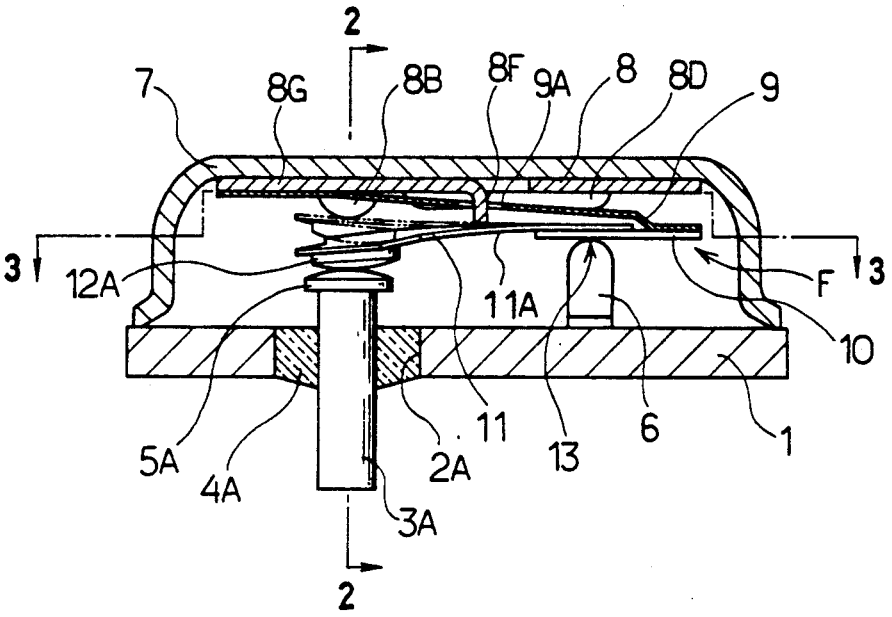
FIG. 1 is a longitudinally sectional view of a three-phase thermal protector of a first embodiment in accordance with the present invention.
Figure 2:
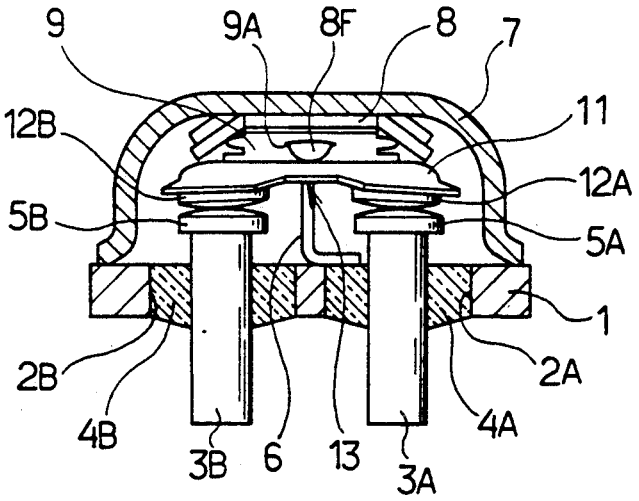
FIG. 2 is a sectional view taken along line 2—2 in FIG. 1.
Figure 3:
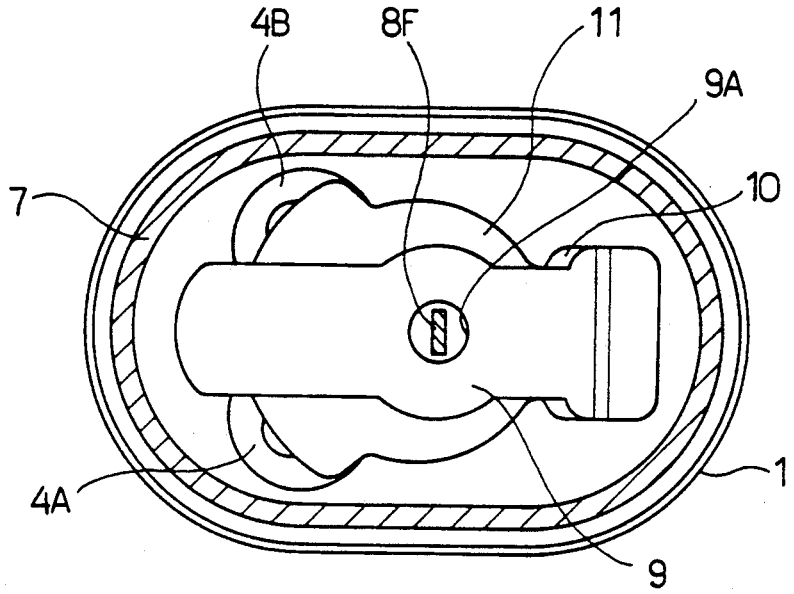
FIG. 3 is a sectional view taken along line 3—3 in FIG. 1.

A first embodiment of the present invention will now be described with reference to FIGS. 1 to 5. Referring to FIGS. 1-3, a header plate 1 has opposite semicircular ends and a planar section between the semicircular ends. The planar section includes a uniform width portion. The header plate 1 has two through-apertures 2A and 2B formed in it to be symmetrical to each other about a center line equally dividing the width of the header plate 1 into two parts. Two electrically conductive terminal pins 3A and 3B are inserted through the apertures 2A, 2B and hermetically secured in the apertures 2A, 2B by electrically insulative fillers 4A and 4B such as glass, respectively. Fixed contacts 5A and 5B formed from silver or a silver alloy are secured on end faces of the terminal pins 3A, 3B positioned in a hermetic receptacle which will be described later, respectively. A protrusion 6 is mounted on a face of the header plate 1 positioned inside the hermetic receptacle. The protrusion 6 provides for a fulcrum of a thermally responsive element, as will be described in detail later.

Figure 4:
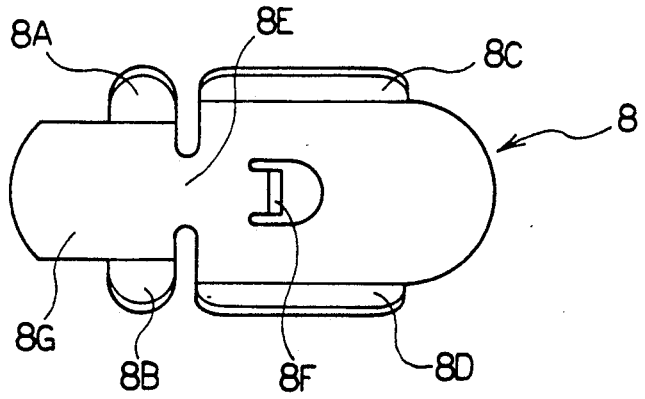
FIG. 4 is a bottom of a thermally-responsive-element support employed in the protector of the first embodiment.

A cover 7 has an opening whose width is larger than the depth of the cover 7. The cover 7 has spherical portions at opposite ends thereof and a portion with a circular-arc section between the ends such that the cover 7 is formed into the shape of an elliptic dome. The header plate 1 is hermetically secured to the opening edge of the cover 7 by way of a ring projection welding so that a hermetic receptacle is formed. The cover 7 has a high-level strength since it is formed into the shape of the elliptic dome. Accordingly, the cover 7 is rendered thinner than the header plate 1. An operating temperature calibrating plate 8 is secured at its securing portion 8G to the inner wall of the cover 7 by way of welding. The operating temperature calibrating plate 8 has ribs 8A through 8D dispersively formed on its periphery so that the plate 8 has a sufficient stiffness, as is shown in FIG. 4. On the other hand, the operating temperature calibrating plate 8 has a narrow portion 8E with a smaller width in the vicinity of the securing portion 8G so that it is bendable in the operating temperature calibration. The operating temperature calibrating plate 8 has a central push projection 8F cut and raised so that it is engaged with a thermally responsive element 11 through an opening formed in a first or thermally-responsive-element support 9 supporting the thermally responsive element 11 and formed of a metal. The first support 9 has one end secured to the securing portion 8G of the operating temperature calibrating plate 8. The first support has a high stiffness against a force applied thereto along its plane and such an elasticity that it is readily bent in the direction intersecting perpendicularly to the direction along the plane. The first support 9 has a cutout portion or an aperture 9A through which the push projection 8F of the operating temperature calibrating plate 8 extends as described above.

The thermally responsive element 11 is secured to the other end of the first support 9 with a lug plate 10 interposed therebetween for the purpose of welding. The thermally responsive element 11 is formed of a material deforming in response to the temperature change, such as a bimetal or trimetal. The central portion of the material is drawn into a generally circular, shallow dish-shaped portion 11A so that the thermally responsive element 11 reverses its curvature with a snap action at predetermined different operating temperatures. The thermally responsive element 11 carries two movable contacts 12A and 12B which are operatively associated with the respective fixed contacts 5A, 5B. The movable contacts 12A and 12B are secured, by way of welding, to respective portions of the thermally responsive element 11 substantially symmetrical about a center line passing through the center of the secured portion of the thermally responsive element 11 and the lug plate 10 and the center of the secured portion of the first support 9 and the lug plate 10.

The movable contacts 12A, 12B and the lug plate 10 are welded to the thermally responsive element 11 after it has been drawn. Subsequently, an aging step of the thermally responsive element 11 is performed. In the aging step, the thermally responsive element 11 is left in a thermostatic oven whose temperature is set at a predetermined value, for example, 300° C. for the purpose that the different operating temperatures at which the thermally responsive element 11 reverses and restores its curvature respectively are not varied for a long period. If the thermally responsive element 11 should be directly welded to the first support 9 after the above-mentioned aging, the heat due to the welding would vary the operating temperatures at which it reverses and restores the curvature. The lug plate 10 is provided for preventing the influence of the heat due to the welding upon the thermally responsive element 11. However, the lug plate 10 may be eliminated in the case where the aging can be performed after the welding of the thermally responsive element 11 to the first support 9 or where the variation in the operating temperatures of the thermally responsive element 11 is sufficiently small when the thermally responsive element 11 is directly welded to the first support 9 after execution of the aging step.

The thermally responsive element 11 has a fulcrum position 13 on the above-described center line in the vicinity of its supported end. The fulcrum position 13 of the thermally responsive element 11 is received by a distal end of the protrusion 6 so that the thermally responsive element 11 is inclinably moved slightly about the distal end of the protrusion 6 as a fulcrum. Although the lug plate 10 is interposed between the thermally responsive element 11 and the protrusion 6 in the embodiment, this arrangement does not influence the operation of the thermally responsive element 11.

Figure 5:
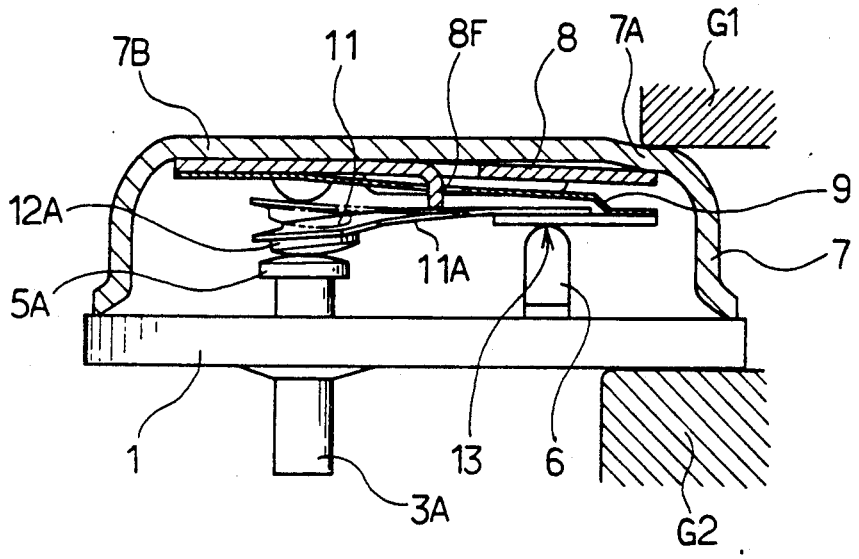
FIG. 5 is a longitudinally sectional view of the protector of the first embodiment held between two jigs for explanation of a method of calibrating the operating temperature.

The calibration of the operating temperatures of the thermally responsive element 11 will now be described. After assembled by securing the header plate 1 to the cover 7, the hermetic receptacle is held by jigs G1 and G2 at its top and bottom ends opposed to the securing portion 8G of the operating temperature calibrating plate 8, as is shown in FIG. 5. A portion 7A of the cover 7 in the vicinity of the right-hand spherical portion is deformed so that the thermally responsive element 11 reverses its curvature at a predetermined temperature so as to assume the position shown by a dotted line in FIG. 1 or 5. Consequently, the narrow portion 8E of the operating temperature calibrating plate 8 is bent downwards, as viewed in FIG. 5, so that a pushing force is applied to the convex side of the thermally responsive element 11 at the normal temperature, through the push projection 8F. This pushing force is received at the two fixed contacts 5A, 5B and the fulcrum position 13, whereby the contact pressure of each contact pair is increased so that the thermally responsive element 11 reverses its curvature with a snap action at the predetermined temperature. In this case, a force exerted on the thermally responsive element 11 by the first support 9 causes the element 11 to be pressed at the fulcrum position 13 against the distal end of the protrusion 6 and brings about a biasing force inclining the thermally responsive element 11 about the fulcrum position 13 in the clockwise direction in FIG. 1 or 5. Accordingly, the movable contacts 12A, 12B can be reliably disengaged from the respective fixed contacts 5A, 5B when the thermally responsive element 11 reverses its curvature with a snap action. Furthermore, this biasing force can prevent chattering caused at the time of disengagement of the movable contacts 12A, 12B from the respective fixed contacts 5A, 5B. Thus, the thermally responsive element 11 can reverse its curvature accurately at the calibrated, predetermined operating temperature.

An approximately equal reactive force is applied to each of the movable contacts 12A, 12B since the contact points of the respective pairs of movable and fixed contacts are symmetrical about the center line connecting the fulcrum position 13 and the push projection 8F. Consequently, the two movable contacts 12A, 12B are disengaged from the respective fixed contacts 5A, 5B approximately simultaneously. Furthermore, the thermally responsive element 11 is supported by the first support 9 which is elastically deformable relatively easily in the direction intersecting perpendicularly to the planar portion of the support 9. Consequently, even when errors caused during the assembly slant the thermally responsive element 11, the bias of the reactive force exerted on the respective contact pairs can be absorbed by the first support 9. A so-called self-aligning equalizing the reactive force can be provided.

Furthermore, the deformation of one portion of the hermetic receptacle is converted to the deformation of the operating temperature calibrating plate 8 and the pushing force is applied to the thermally responsive element 11 from the push projection 8F. Consequently, the operating temperatures of the thermally responsive element 11 can be adjusted accurately as compared with those in the arrangement that the operating temperature calibrating plate is not employed. More specifically, the narrow portion 8E acts as a fulcrum when the operating temperature calibrating plate 8 is bent and the portion 7A acts as a point of application of the force exerted by the jigs G1, G2 for the calibration of the operating temperatures of the thermally responsive element 11 in the embodiment. The distance between the portion 8E as the fulcrum and the portion 7A as the point of application is twice as long as the distance between the push projection 8F and the application point 8E or more, as is obvious from FIGS. 4 and 5. Accordingly, an amount of displacement of the push projection 8F is one half of an amount of deformation of the portion 7A of the cover 7 or below. Consequently, an accurate calibration of the operating temperatures of the thermally responsive element 11 can be achieved in the embodiment as compared with a conventional construction that a protector housing has a depressed portion which is directly displaced. Furthermore, in case that a portion 7B side of the receptacle is held by the jigs G1, G2 so that the portion 7B of the cover 7 near the contacts is deformed for the purpose of calibration of the operating temperature, the inter-contact distance between the contacts of each contact pair is reduced in the off-state with the increase in the amount of deformation in the portion 7B. Accordingly, this reduction of the inter-contact distance needs to be taken into account when calibration of the operating temperature is performed. However, the inter-contact distance in the off-state can be maintained at a suitable value irrespective of the amount of deformation of the cover 7 when the deformed portion of the cover 7 is positioned oppositely to the side of the contacts, as in the embodiment. Moreover, an amount of spring back is extremely small since the deformed portion 7A belongs to a curved portion of the elliptic dome-shaped cover, and the configuration of the cover 7 after the deformation retains its tightness against an external pressure.

In the thermal protector constructed as described above, when the ambient temperature reaches a first predetermined temperature, for example, 130° C., the thermally responsive element 11 reverses its curvature with a snap action, assuming a suitable position defined by the ribs 8A, 8B of the operating temperature calibrating plate 8 as shown by dotted line in FIG. 1 or 5, thereby disengaging the movable contacts 12A, 12B from the respective fixed contacts 5A, 5B. Thereafter, when the ambient temperature falls to a second predetermined temperature, for example, 90° C., the thermally responsive element 11 restores its former curvature with a snap action so that the two pairs of the movable contacts 12A, 12B and the fixed contacts 5A, 5B are simultaneously closed as shown by solid line in FIG. 1 or 5.

An amount of heat generated by each of the parts such as the thermally responsive element 11 composing an electric circuit is increased when some failure or other in a motor to be protected by the thermal protector increases an electric current. Consequently, when the temperature of the thermally responsive element 11 reaches its operating temperature, it reverses its curvature with a snap action so that the movable contacts 12A, 12B are disengaged from the respective fixed contacts 5A, 5B, thereby interrupting energization of the motor.

The electric current to flow into the first support 9 is bypassed via the fulcrum position 13 since the protrusion 6 formed of a metal is employed in the embodiment. An electric resistance value of the first support 9 is set at a small value when the terminal pins 3A, 3B are the only heating elements at the fixed contact side. An electric current path is formed by the header plate 1, cover 7, operating temperature calibrating plate 8, first support 9, lug plate 10, and thermally responsive element 11 in turn, these parts being connected to one another by way of welding or the like. The total resistance value of the above-mentioned electric current path can be rendered as small as possible relative to the contact resistance between the protrusion 6 and the lug plate 10 at the fulcrum position 13. Moreover, most of the heat induced in the receptacle is generated by the thermally responsive element 11. Consequently, the above-mentioned contact resistance between the protrusion 6 and the lug plate 10 does not constitute an obstacle to the operative characteristics of the protector. It is preferable that the protrusion 6 be formed of an electrically insulative material or that the portion of the protrusion 6 in contact with the lug plate 10 be insulated by a ceramic or the like. Furthermore, although a portion of the operating temperature calibrating plate 8 is cut and raised so as to directly serve as the push projection 8F in the embodiment, this construction does not hinder the operative characteristics of the protector for the same reason as described above. An electrically insulative material may be employed for a portion of the push projection 8F in engagement with the thermally responsive element 11 so that the push projection 8F is electrically insulated from the thermally responsive element 11.

Figure 6:
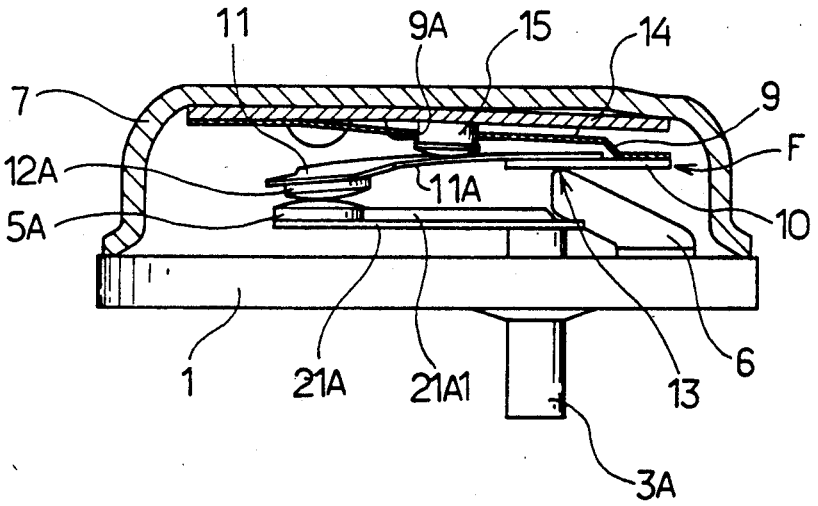
FIG. 6 is a view similar to FIG. 5 showing a second embodiment of the invention without the jigs.

FIG. 6 illustrates a second embodiment of the invention. In the three-phase thermal protector as disclosed herein, the terminal pins 3A, 3B and the header plate 1 of the protector are connected to the side of a neutral of three windings connected in a wye configuration in the three-phase induction motor. Sufficient protection cannot be provided in an abnormal condition of the motor when the thermal protector is operated in response only to the heat transferred from the motor to the thermal protector. Therefore, the thermal protector is designed so that an internal heat generated in the protector exerts an influence upon the operation of the thermally responsive element. Furthermore, the thermal protector needs to have such a construction that the thermal protector should generate heat more positively to exert a greater influence upon the operation of the thermally responsive element when the internal heat is insufficient for the protection of the motor. The thermal protector of the second embodiment satisfies this necessity. The same parts in FIG. 6 as those in FIGS. 1–3 are labeled by the identical reference numerals.

The header plate 1 has the two through-apertures 2A, 2B (not shown) whose positions are opposite to those in the first embodiment with respect to the lengthwise direction of the cover 7 and the two terminal pins 3A, 3B only one of which is shown are disposed through the respective apertures 2A, 2B in the same manner as in the first embodiment. The fixed contacts 5A, 5B only one of which is shown are conductively secured to respective second or fixed-contact supports 21A and 21B only one of which are shown and which are conductively secured to the respective terminal pins 3A, 3B. The second supports 21A, 21B are disposed to be substantially parallel to the header plate 1. The fixed contacts 5A, 5B are positioned so as to be symmetrical to each other about the center line equally dividing the width of the header plate 1 into two parts. The fixed contacts 5A, 5B are further positioned so that the movable contacts 12A, 12B are engaged with and disengaged from the respective fixed contacts 5A, 5B. The second supports 21A, 21B are disposed to be substantially parallel to the thermally responsive element 11 so that they can exert an effective thermal influence upon the thermally responsive element 11. Two ribs 21A1 only one of which is shown are mounted on the respective second supports 21A, 21B to enhance the strength of the respective supports. The protrusion 6 is designed to operate in the same manner as in the previous embodiment though the positional relationship between the terminal pins 3A, 3B and the through-apertures 2A, 2B differs from that in the previous embodiment.

The operating temperature calibrating plate 14 differs from the plate 8 in that a push projection 15 formed of an electrically insulative material such as a ceramic is provided on the portion of the plate 14 corresponding to the position of the cut and raised portion 8F of the plate 8.

The operation of the thermal protector of the second embodiment will be described. Phase currents are usually balanced with one another in the three-phase induction motors. In such a case, electric currents flow between the terminal pins 3A, 3B, between the terminal pin 3A and the header plate 1, and between the terminal pin 3B and the header plate 1 respectively. These currents need to cause approximately equal temperature rise of the thermally responsive element 11. For this purpose, the thermally responsive element 11 is designed and its parts are selected in consideration of the electrical resistance values of the parts composing each of the above-described electric current paths and the thermal effect upon the thermally responsive element 11. More specifically, the designing of the thermal protector and selection of the parts are performed in consideration of the distance between the movable contacts 12A, 12B carried by the thermally responsive element, the distance between the secured portion of the first support 9 and the thermally responsive element 11 and each of the fixed contacts 5A, 5B, an amount of heat generated from the thermally responsive element 11 as a heating element and from the two second supports 21A, 21B, and the thermal effects depending upon the positional relationship between these heating elements and the thermally responsive element 11.

The thermal effect of each heating element upon the thermally responsive element 11 also has a great significance for the motor protection in the case of a phase interruption. That is, when the thermal effect of each heating element upon the thermally responsive element 11 is not balanced, the amount of heat generated and the thermal effect upon the thermally responsive element are varied depending upon which one of the phases has been interrupted, when the phase interruption occurs in the three-phase induction motor for some cause or other. These variations in the amount of heat generated and the thermal effect upon the thermally responsive element are not desirable from the standpoint that the thermal protector is provided for protecting the three-phase induction motor against the phase interruption, an overcurrent and an overload condition. More specifically, an operation period refers to a period between the time the thermally responsive element 11 reverses its curvature with a snap action and the time the movable contacts are disengaged from the respective fixed contacts. A return period refers to a period from the open circuit condition to the time the movable contacts are re-engaged with the respective fixed contacts. A so-called "must-hold" current value refers to the value of a maximum current not causing the thermally responsive element to reverse its curvature with a snap action. It is desirable that the values of the above-mentioned operation period, return period and must-hold current should be approximately equal respectively both when the current flows between the terminal pins 3A, 3B and when the current flows between either terminal pin 3A, 3B and the header plate 1.

A predetermined relation between the amount of generated heat and the distance can be adjusted readily in the second embodiment since the first support 9 and the two second supports 21A, 21B are disposed in substantially parallel to the thermally responsive element 11. Consequently, the thermal effect upon the thermally responsive element 11 can be readily adjusted to be produced under the uniform condition. Furthermore, the second supports 21A, 21B each serving as a heating element are disposed to be substantially parallel to the thermally responsive element 11 and to place it therebetween. As a result, the response of the thermally responsive element 11 to the heat generated by the heating elements can be improved and heat radiation of the thermally responsive element 11 can be retarded. Consequently, a ratio of the operation period to the return period can be improved in the thermally responsive element 11, which can improve its service life.

FIGS. 7 through 10 illustrate a third embodiment of the invention. The same parts in FIGS. 7–10 as those in FIGS. 1–3 and 6 are labeled by the identical reference numerals. In the third embodiment, the fixed contacts 5A, 5B are conductively secured to respective second or fixed-contact supports 24A and 24B which are further conductively secured to the respective terminal pins 3A, 3B. Openings 24A1 and 24B1 are formed in the respective second supports 24A, 24B so that the amount of heat generated by the second supports 24A, 24B are increased by increasing their electrical resistance values. A spacer 22 serving as a reinforcement is provided between the second supports 24A, 24B and the header plate 1. The spacer 22 is formed of an electrically insulative material such as a ceramic. The spacer 22 has recesses 22D1 and 22D2 formed in its side opposed to the side facing the header plate 1. The second supports 24A, 24B are disposed in the recesses 22D1, 22D2 respectively. The spacers 22D1, 22D2 thus serve to position, reinforce, and support the respective second supports 24A, 24B and to keep them electrically insulative from the header plate 1. The spacers 22D1, 22D2 further serve to prevent a tracking caused on the surface of the insulator by products such as silver oxide resulting from an arc formed between the contact pairs during separation of the contacts. The spacer 22 is in contact with the header plate 1 only at three supporting points 22A, 22B and 22C and accordingly, these contact points are hard to be contaminated with the above-mentioned products. A support protrusion 22E is provided on the side of the spacer 22 opposed to the thermally responsive element 11. The distal end of the support protrusion 22E is engaged with the fulcrum 23 of the thermally responsive element 11.

The push projection member 15 is mounted on the operating temperature calibrating plate 14, extending through the aperture formed in the first support 9 supporting the thermally responsive element 11. The push projection member 15 collides with the thermally responsive element 11 on its center line, applying a pressing force to it. The push projection member 15 employed in the third embodiment is formed of an electrically insulative material such as a ceramic and is designed to reliably prevent the electric current from bypassing from the operating temperature calibrating plate 9 to the thermally responsive element 11.

A detailed description of the operating temperature calibration will be eliminated since its manner is the same as in the first embodiment. It is sufficient only to describe that the pressing force is applied to the thermally responsive element 11 via the operating temperature calibrating plate 14 and the push projection member 15 for calibration of the operating temperature and that the applied depressing force is dispersed at the fixed contacts 5A, 5B and the protrusion 22E of the spacer 22 and opposed to one another.

Figure 7:
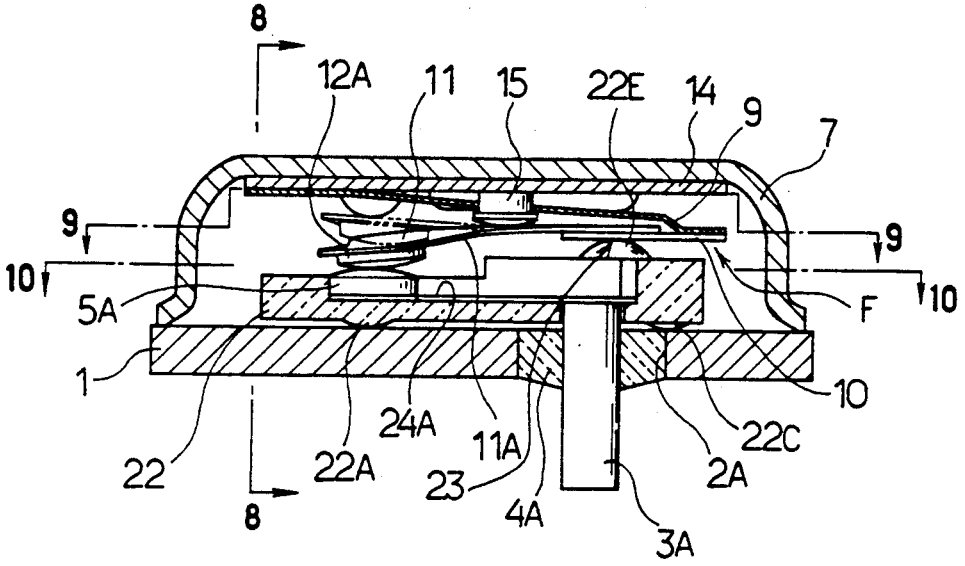
FIG. 7 is a view similar to FIG. 1 showing a third embodiment of the invention.
Figure 8:
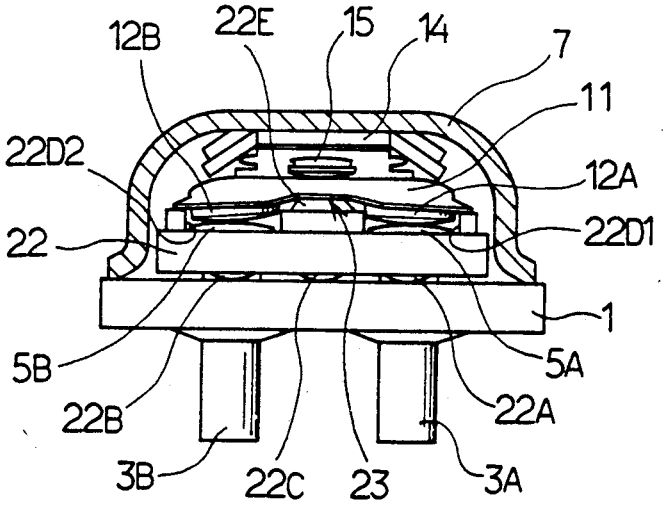
FIG. 8 is a sectional view taken along line 8—8 in FIG. 7.
Figure 9:
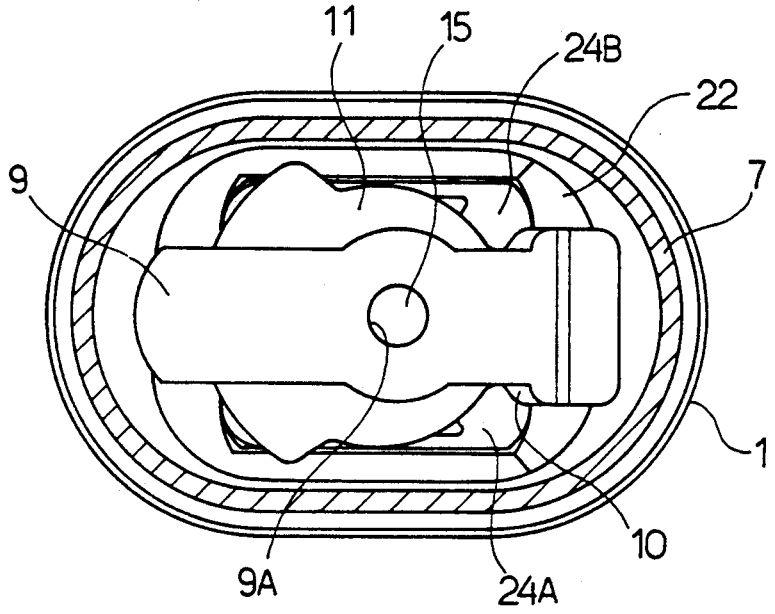
FIG. 9 is a sectional view taken along line 9—9 in FIG. 7.
Figure 10:
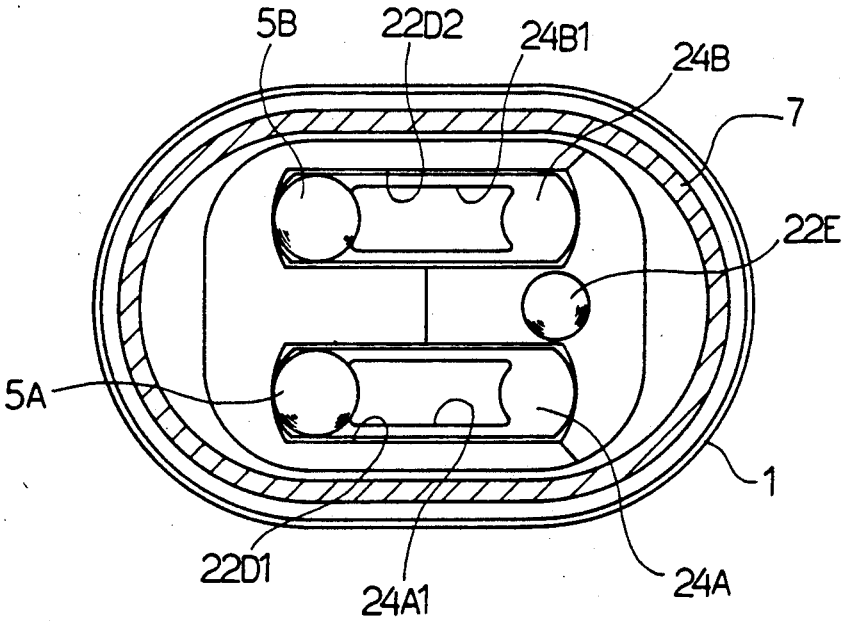
FIG. 10 is a sectional view taken along line 10—10 in FIG. 7.

In the thermal protector of the type disclosed herein, the electrical resistance of the parts composing the electric current paths is conventionally increased by reducing the sectional area of these parts in order that the amount of heat generated is increased. For example, the thickness of the first support 9 is reduced in order that the electrical resistance value of the first support 9 is increased. In this case, the first support 9 cannot be designed so as to have a sufficient strength. Consequently, the movable contacts 12A, 12B are tack-welded to the respective fixed contacts 5A, 5B and the movable contacts 12A, 12B are not separated from the respective fixed contacts 5A, 5B when the thermally responsive element 11 reverses its curvature, even if the tack-welding is slight. Consequently, the supported end side of the thermally responsive element 11, that is, the portions F in FIGS. 1, 6 and 7 are rotatively displaced to depart from the respective protrusions 6, 22E. Also, when the force of the tack-welding is strong, the contacts are not separated such that the supported end side of the thermally responsive element 11 is rotatively moved, even if the thermally responsive element 11 has a normal strength.

The first support 9 applies a sufficient biasing force to the supported end side of the thermally responsive element 11 such that the element 11 is inclined about the protrusion 22E in the clockwise direction, when the first support 9 has a sufficient strength. Even when the contacts are tack-welded, the contacts can be separated if the biasing force of the first support 9 is stronger than the strength of the tack-welding. However, when the thickness of the first support 9 is reduced such that a sufficient strength cannot be achieved, the strength of the tack-welding would exceed the biasing force of the support 9. As a result, the contacts cannot be separated even when the tack-welding is slight, and accordingly, the supported end of the thermally responsive element 11 departs from the protrusion 22E.

Figure 11:
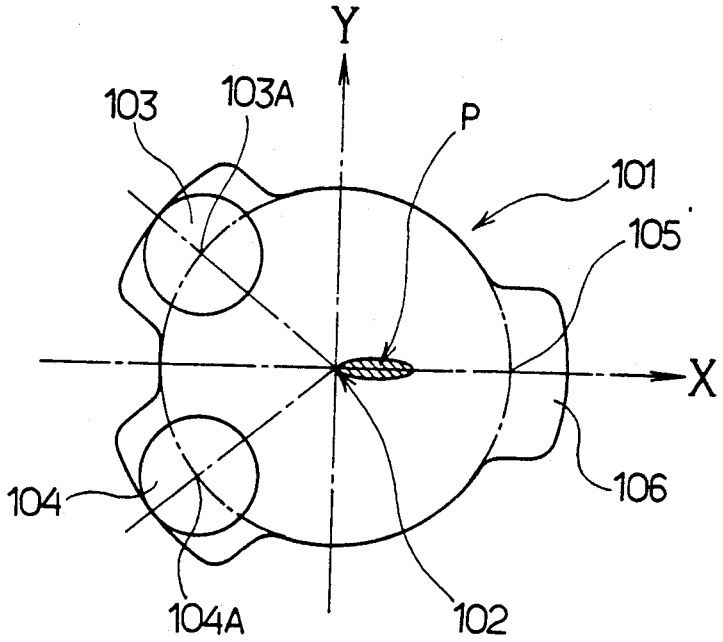
FIG. 11 is a schematic plan view of the thermally responsive element for explaining forces applied to the element and positions of the forces.

The above-described problem will be further described with reference to FIG. 11. In FIG. 11, in case where the center 102 of the dish-shaped portion of the thermally responsive element 101 is depressed by the push projection, reactive forces acting on three points are equal when the distances between the fulcrum 105 and the respective fixed contacts are equal. Accordingly, the two contact pairs are operated under the same operating condition when the thermally responsive element 101 reverses its curvature. Actually, however, the biasing force is applied by the first support to the supported end 106 of the thermally responsive element positioned outside the fulcrum 105 so that the thermally responsive element 101 is biased in the direction opposite the direction in which it reverses its curvature. Accordingly, when reversing its curvature, the thermally responsive element 101 supported at the dish shaped portion center 102, the fulcrum 105 and the supported end 106 moves the movable contacts 103, 104 so that they are separated from the respective fixed contacts Even in the case where the movable contact 103 or 104 is tack-welded to the fixed contact, it is separated from the fixed contact when the biasing force of the support exceeds the strength of the tack-welding. However, when the strength of the tack-welding exceeds the biasing force, the movable contact is not separated from the fixed contact and the supported end of the thermally responsive element is moved. Furthermore, when the first support does not have a sufficient strength because of its reduced thickness or for other reasons, the movable contact is not also separated from the fixed contact even if the degree of the tack-welding is lower.

In each of the foregoing embodiments, the point of the thermally responsive element 11 at which it is depressed by the push projection 8F, 15 is shifted toward its supported end relative to the center 11A of the dish shaped portion. Accordingly, the reactive force acting on the fulcrum position 13, 23 at the supported end side can be rendered larger than the reactive force acting on each movable contact. Consequently, the depressing force compensating for the biasing force can be applied to the supported end of the thermally responsive element even when the first support 9 has a lower strength so that its thickness is reduced for increase of its electrical resistance value. Thus, the movable contacts can be reliably separated from the respective fixed contacts under various operating conditions.

Experiments made by the inventors show that the calibration of the operating temperature is not influenced when the above mentioned depressed point of the thermally responsive element belongs to a section, which is shown by P in FIG. 11, between the center of the dish-shaped portion 11A and a point at a distance of a quarter of the overall length of the thermally responsive element toward its supported end. In this construction, the movable contacts can be reliably separated from the respective fixed contacts even in the occurrence of the tack-welding of the contacts when the first support 9 has a lower strength because of reduction of its thickness for increasing its electrical resistance value or even when the tack-welding of the contacts is in such a degree that the contacts cannot be separated in the conventional construction. Additionally, the calibration of the operating temperature is not influenced by the above-described construction.

Furthermore, the above-described section P of the depressed point of the push projection can simplify the foregoing self-aligning. That is, the depressed point as the point of support is away from both of the movable contacts as the points of application where the reactive force is produced, in the condition that the thermally responsive element is depressed at the depressed point by the push projection. Accordingly, not only a torque due to the torsion about the x-axis in FIG. 11 but also a torque due to the torsion about the y-axis are produced, which can make it easy adjustment of the reactive force biased by the flexure of the first support.

Additionally, when the depressed point of thermally responsive element is away from the both of the movable contacts, the distance between the movable and fixed contacts in each contact pair can be increased in the state that the contacts are separated. Consequently, the withstand voltage of each contact pair can be improved.

The foregoing disclosure and drawings are merely illustrative of the principles of the present invention and are not to be interpreted in a limiting sense. The only limitation is to be determined from the scope of the appended claims.

We claim:

1. A three-phase thermal protector comprising:

a) a hermetic receptacle comprising a cover formed of a metallic material and having an opening the width of which is larger than the depth of the cover, and a header plate hermetically secured to an opening edge of the cover and having two through-apertures;

b) two electrically conductive terminal pins inserted through the respective through-apertures of the header plate, each terminal pin being hermetically secured in each through-aperture by an electrically insulating material filling a space between the peripheral wall surface of each aperture and the outer periphery of each terminal pin, each terminal pin having an end placed in the interior of the hermetic receptacle and a fixed contact electrically conductively connected to the end;

c) an operating temperature calibrating plate formed of a metallic material and disposed in the receptacle, the operating temperature calibrating plate having an end side secured to the cover of the receptacle by way of welding and a suitable portion more bendable than the other portion thereof;

d) a thermally-responsive-element support having one of two ends secured to the operating temperature calibrating plate and a cutout portion at a suitable portion thereof, the thermally-responsive-element support being elastically deformable easily in a direction intersecting perpendicularly to a plane thereof;

e) a thermally responsive element having a supported end secured to the other end of the thermally-responsive-element support and a generally central shallow dish-shaped portion reversing its curvature with a snap action at predetermined temperatures, the thermally responsive element carrying two movable contacts on respective portions thereof substantially symmetrical about a central line passing through the supported end so that the movable contacts are operatively associated with the respective fixed contacts;

f) a protrusion fixedly disposed on the header plate so as to be positioned between the thermally responsive element and the header plate, the protrusion having a distal end in contact with a portion of an underside of the thermally responsive element away from the central portion thereof toward the supported end, the portion of the thermally responsive element in contact with the distal end of the protrusion acting as a fulcrum; and g) a push projection provided on the operating temperature calibrating plate so that a distal end extends through the cutout portion of the thermally-responsive-element support, the distal end pushing a convex side of the thermally responsive element at a room temperature, in the vicinity of a portion thereof on which the center line passes through the supported end such that a pushing force of the push projection is dispersed equally to the distal end of the protrusion and the fixed contacts, the push projection being moved with movement of a free end of the operating temperature calibrating plate upon displacement applied to the cover of the receptacle for calibration of an operating temperature.

2. A three-phase thermal protector according to claim 1, further comprising two electrically conductive fixed-contact supports having one ends coupled to the conductive terminal pins respectively so as to be disposed substantially in parallel to the header plate and the other ends on which the fixed contacts are disposed respectively, in the hermetic receptacle.

3. A three-phase thermal protector comprising:

a) a hermetic receptacle comprising a cover formed of a metallic material and having an opening the width of which is larger than the depth of the cover, and a header plate hermetically secured to an opening edge of the cover and having two through-apertures;

b) two electrically conductive terminal pins inserted through the respective through-apertures of the header plate, each terminal pin being hermetically secured in each through-aperture by an electrically insulating material filling a space between the peripheral wall surface of each aperture and the outer periphery of each terminal pin, each terminal pin having an end placed in the interior of the hermetic receptacle and a fixed contact electrically conductively connected to the end;

c) two fixed-contact supports formed of an electrically conductive material and disposed in the receptacle so as to be substantially parallel to the header plate, the fixed-contact supports having one portions coupled to the terminal pins respectively and one ends on which fixed contacts are disposed respectively;

d) an electrically insulating reinforcement member interposed between the header plate and the fixed contact support for reinforcing the fixed-contact supports;

e) an operating temperature calibrating plate formed of a metallic material and disposed in the receptacle, the operating temperature calibrating plate having an end side secured to the cover of the receptacle by way of welding and a suitable portion more bendable than the other portion thereof;

f) a thermally-responsive-element support having one of two ends secured to the operating temperature calibrating plate and a cutout portion at a suitable portion thereof, the thermally responsive-element support being elastically deformable easily in a direction intersecting perpendicularly to a plane thereof;

g) a thermally responsive element having a supported end secured to the other end of the thermally-responsive-element support and a generally central shallow dish-shaped portion reversing its curvature with a snap action at predetermined temperatures, the thermally responsive element carrying two movable contacts on respective portions thereof substantially symmetrical about a central line passing through the supported end so that the movable contacts are operatively associated with the respective fixed contacts;

h) a protrusion fixedly disposed on the header plate so as to be positioned between the thermally responsive element and the header plate, the protrusion having a distal end in contact with a portion of an underside of the thermally responsive element away from the central portion thereof toward the supported end, the portion of the thermally responsive element in contact with the distal end of the protrusion acting as a fulcrum; and i) a push projection provided on the operating temperature calibrating plate so that a distal end thereof extends through the cutout portion of the thermally-responsive-element support, the distal end pushing a convex side of the thermally responsive element at a room temperature, in the vicinity of a portion thereof on which the center line passes through the supported end such that a pushing force of the push projection is dispersed equally to the distal end of the protrusion and the fixed contacts, the push projection being moved with movement of a free end of the operating temperature calibrating plate upon displacement applied to the cover of the receptacle for calibration of an operating temperature.

4. A three-phase thermal protector according to claim 2, wherein the thermally-responsive-element support and the fixed-contact support are disposed to be substantially parallel to a plane of the thermally responsive element.

5. A three-phase thermal protector according to claim 3, wherein the thermally-responsive-element support and the fixed-contact support are disposed to be substantially parallel to a plane of the thermally responsive element.

6. A three-phase thermal protector according to claim 1, wherein the push projection pushes the thermally responsive element at a point thereon belonging to a section between the center of the dish-shaped portion and a point at a distance of a quarter of the overall length of the thermally responsive element from the end carrying the movable contacts.

7. A three-phase thermal protector according to claim 2, wherein the push projection pushes the thermally responsive element at a point thereon belonging to a section between the center of the dish-shaped portion and a point at a distance of a quarter of the overall length of the thermally responsive element from the end carrying the movable contacts.

8. A three-phase thermal protector according to claim 3, wherein the push projection pushes the thermally responsive element at a point thereon belonging to a section between the center of the dish-shaped portion and a point at a distance of a quarter of the overall length of the thermally responsive element from the end carrying the movable contacts.

9. A three-phase thermal protector according to claim 4, wherein the push projection pushes the thermally responsive element at a point thereon belonging to a section between the center of the dish-shaped portion and a point at a distance of a quarter of the overall length of the thermally responsive element from the end carrying the movable contacts.

10. A three-phase thermal protector according to claim 5, wherein the push projection pushes the thermally responsive element at a point thereon belonging to a section between the center of the dish-shaped portion and a point at a distance of a quarter of the overall length of the thermally responsive element from the end carrying the movable contacts.

* * * * *